US010829289B2

(12) United States Patent
Proulx et al.

(10) Patent No.: US 10,829,289 B2
(45) Date of Patent: Nov. 10, 2020

(54) DEVICE FOR STORING, TRANSPORTING AND/OR HANDLING A LIQUID AND METHOD OF HANDLING A STERILE OR ASEPTIC LIQUID

(71) Applicant: EMD Millipore Corporation, Burlington, MA (US)

(72) Inventors: Stephen Proulx, Boxborough, MA (US); David DeCoste, Chelmsford, MA (US)

(73) Assignee: EMD Millipore Corporation, Burlington, MA (US)

( * ) Notice: Subject to any disclaimer, the term of this patent is extended or adjusted under 35 U.S.C. 154(b) by 109 days.

(21) Appl. No.: 15/743,361

(22) PCT Filed: Aug. 15, 2016

(86) PCT No.: PCT/US2016/046980
§ 371 (c)(1),
(2) Date: Jan. 10, 2018

(87) PCT Pub. No.: WO2017/069839
PCT Pub. Date: Apr. 27, 2017

(65) Prior Publication Data

US 2019/0002176 A1 Jan. 3, 2019

Related U.S. Application Data

(60) Provisional application No. 62/245,021, filed on Oct. 22, 2015.

(51) Int. Cl.
*B65D 79/00* (2006.01)
*B65D 21/02* (2006.01)
(Continued)

(52) U.S. Cl.
CPC ..... *B65D 79/00* (2013.01); *B65D 21/023* (2013.01); *B65D 21/0215* (2013.01);
(Continued)

(58) Field of Classification Search
CPC ..... B65D 21/0215; B65D 21/023; B65D 2519/00572; B65D 2519/00796;
(Continued)

(56) References Cited

U.S. PATENT DOCUMENTS 2,256,657 A * 9/1941 Swabacker ..... A61M 5/14 206/364
2,259,276 A * 10/1941 Swabacker ..... A61M 5/14 206/364
(Continued)

FOREIGN PATENT DOCUMENTS

CN 101337104 A 1/2009
EP 2386327 A1 11/2011
(Continued)

OTHER PUBLICATIONS

International Search Report and Written Opinion received for PCT Patent Application No. PCT/US2016/046980, dated Jan. 3, 2017, 15 pages.

*Primary Examiner* — Andrew M Tecco
*Assistant Examiner* — Nicholas E Igbokwe
(74) *Attorney, Agent, or Firm* — EMD Millipore Corporation

(57) ABSTRACT

A device for storing, transporting and/or handling a liquid or liquids and methods for using the device are described. The device is suitable for use with sterile or aseptic liquids, particularly with large liquid volumes such as 10-1000 liters or more, and avoids the need for bags, bins and carriers commonly used for storing and transporting large volumes of liquids. The device comprises a coiled tubing. The coiled
(Continued)

tubing can be loaded onto a spool to support the coiled tubing. The tubing can be filled, sealed, stored and transported in a more robust manner than previously achieved with bags, bins and carriers.

11 Claims, 7 Drawing Sheets

(51) Int. Cl.
*B65D 85/04* (2006.01)
*A61J 1/00* (2006.01)
*B65D 19/00* (2006.01)

(52) U.S. Cl.
CPC ..... *B65D 85/04* (2013.01); *A61J 1/00* (2013.01); *B65D 19/0069* (2013.01); *B65D 2519/00572* (2013.01); *B65D 2519/00796* (2013.01); *B65D 2519/00955* (2013.01)

(58) Field of Classification Search
CPC ..... B65D 2519/00955; B65D 85/04; B65D 19/0069; A61M 39/08; A61M 5/14; A61M 5/1418
USPC ..... 604/905
See application file for complete search history.

(56) References Cited

U.S. PATENT DOCUMENTS 2,322,701 A * 6/1943 Nesset ..... A61M 5/14 422/1
2,333,684 A * 11/1943 Schwab ..... A61J 1/05 206/438
4,846,794 A * 7/1989 Hertzer ..... A61M 39/08 604/83
4,869,398 A * 9/1989 Colvin ..... A61J 1/1462 222/83
5,309,604 A * 5/1994 Poulsen ..... A61M 5/1418 24/16 R
5,344,011 A * 9/1994 DiBernardo ..... A61M 25/002 206/364
6,004,346 A * 12/1999 Wolff ..... A61F 2/90 623/1.12
6,019,779 A * 2/2000 Thorud ..... A61F 2/88 606/198
2003/0122021 A1* 7/2003 McConnell ..... A61M 39/08 242/388.1
2004/0035743 A1* 2/2004 Tighe ..... A61M 5/1456 206/571
2004/0249364 A1* 12/2004 Kaploun ..... A61K 9/0031 604/891.1
2010/0279354 A1* 11/2010 de Crecy ..... C12P 7/6463 435/71.1
2013/0178836 A1* 7/2013 Teutsch ..... A61M 5/14 604/533
2017/0056218 A1* 3/2017 Fox ..... A61F 2/97

FOREIGN PATENT DOCUMENTS

GB 2204390 A 11/1988
WO 03/037801 A1 5/2003
WO 2009/059942 A1 5/2009
WO 2010/083951 A1 7/2010
WO 2012/022906 A1 2/2012
WO 2012/038819 A1 3/2012
WO 2013/033720 A1 3/2013
WO 2017/069839 A1 4/2017

* cited by examiner

DEVICE FOR STORING, TRANSPORTING AND/OR HANDLING A LIQUID AND METHOD OF HANDLING A STERILE OR ASEPTIC LIQUID

RELATED APPLICATIONS

The present application is a US National Stage application of International Application No. PCT/US2016/046890, filed Aug. 15, 2016, which claims the benefit of priority of U.S. Provisional Patent Application No. 62/245,021, filing date Oct. 22, 2015, the entire content of each of which is incorporated herein in its entirety.

RELEVANT FIELD

Devices and methods that eliminate the need for bags with special bins and carriers for handling large volumes of liquids, particularly sterile or aseptic liquids. Such liquids include for example, pharmaceuticals, buffers, and/or media.

BACKGROUND

Small volumes of liquids, ranging from a few milliliters or less, and up to 50 or 60 liters, are readily handled in containers such as vials, bottles, bags, and carboys for long- or short-term storage and shipping. Larger volumes of liquids are more typically handled in stainless steel or rigid plastic tanks. More recently, flexible plastic bags have been developed that can handle large volumes of liquids, including pharmaceutical liquids. However, one drawback of such bags is the need for an additional external support system, such as a cage or more preferably a bin, into which the bag must be placed in order to support the bag during and after filling. Such bins are large and cumbersome, costly to make, dispose of and replace, and can only typically accommodate a specific size and style of bag. Flexible bags are also susceptible to damage, such as creasing or wrinkling during the fill stage and during subsequent handling, which in turn can lead to increased stress points in the bag surface that are more susceptible to rupture during storage, handling and transport of the liquid-filled bag.

Another drawback of such large bags is that they are necessarily manufactured with seams, which in turn necessitates strict integrity testing of the bag in order to assure that the seam is not compromised for leaks. Integrity testing of large bags is challenging and not very sensitive when using the typical pressure decay test. The pressure decay test involves pressurizing the bag (or other container being tested) with air and monitoring for any pressure changes. A pressure drop indicates a leak. Unfortunately, large volumes affect how quickly the leak (pressure change) can be seen; long test times are undesirable. Another issue with pressure decay testing large flexible bags is false positives because the test pressure itself can stretch the bag during the test, causing a pressure change indicating a leak where none is actually present. The test pressure has to be minimized to avoid stretching the bag, and avoid false positives, but this can reduce the sensitivity of the test and increase the testing time.

A need exists for a simpler device and method for handling of large volumes of liquids, such as for storing and shipping of pharmaceutical liquids, buffers, media, and the like. Preferably such a device could be readily integrity tested.

SUMMARY

Described herein are devices and methods of storing, transporting and handling liquids, particularly bulk or large volumes of liquids (e.g., about 10, 25, or 50 liters to at least 1000 liters or more). Such devices resist wrinkling or rupture, and are readily integrity tested. These devices are particularly suitable for the aseptic handling of bulk volumes of liquids. In particular, the devices and methods facilitate the aseptic handling of liquids. Such liquids can be any liquid, and include pharmaceuticals, media, buffers, nutrients, bulk drug substance and final drug product. In addition, these liquids may include hazardous materials that require additional safety to pass US DOT and International standards, for example.

In general, a device for storing, transporting and/or handling a liquid comprises a coiled tubing. At least one sterile or aseptic connector may be attached at one end of the tubing. Alternatively, a sterile or aseptic connector may be attached at each end of the tubing.

The coiled tubing can be made from any suitable material, including for example a natural or synthetic material, plastic, thermoplastic, silicone or other material. Such material is preferably a sterilization-stable material. Such sterilization can be achieved using any suitable method, including the use of gamma irradiation, ethylene oxide, vaporized hydrogen peroxide, etc. For the material to be sterilization-stable, the sterilization methods should not adversely affect the chosen tubing material. The tubing, which may be rigid or flexible, may comprise a single material, a composite material, reinforced material, or layers of material. The tubing material can be chosen according to needs and desired function. For example, the tubing may be gas-impermeable, caustic-stable, pressure-resistant, pH-stable, impact-resistant, particle-free, low-extractable, low-leachable, temperature-stable, or a combination thereof.

The tubing may have a single lumen or multiple lumens. In the instance of multiple lumens, one or more of the lumens may be filled, either partially or completely, with a liquid, wherein each liquid in separate lumens can be the same or different. For example, each liquid may be different components of a mixture to be combined upon dispensing from the tubing. Additionally or alternatively, one or more lumens may be filled with a liquid, and an adjacent lumen may be used to flow in a temperature-controlling fluid (e.g., a heated or cooled fluid as needed, such fluids include propylene, ethylene glycol, and the like for modulating the temperature of the tubing and a liquid in one or more of the other lumens). In this manner, the storage and/or transport of a temperature-controlled or frozen liquid product is facilitated. Additionally or alternatively, one or more lumens in a multiple lumen tubing may be partially or completely filled with a gas (e.g., air, an inert gas, etc.). Such a gas-filled lumen may facilitate temperature-controlled storage and transport of a liquid product in the lumen, provide insulation, allow for expansion of a frozen liquid in the tubing, etc.

A recirculating pump, a filter, a sensor, a connector for or a connection to a pressurized gas (e.g. air, such as sterile air or filtered air) source, or a combination thereof, may be connected to the tubing. These can be attached individually or in a group, in series or in parallel.

The device further comprises a spool. One aspect of the spool can be to support the coiled tubing. The spool may also facilitate transportation and/or storage of the coiled tubing (e.g., coiled tubing containing liquid). Generally, the spool comprises an interior drum and two outer sidewalls. The spool may be made from plastic, glass, metal, wood, or a combination thereof. In one aspect, the spool can be reversibly assembled and disassembled into two or more parts. The spool may further comprise legs, support structures, wheels, crank handles, levels, clamps, clips, outer casings, indents, and the like.

The spool can be of any suitable dimension and shape to achieve the purposes of the spool, including supporting the amount of tubing for a desired liquid volume. The dimensions will be determined, at least in part, by the tubing and liquid volume. For example, for the bulk volumes as contemplated herein, the interior drum can range between at least or about 3 inches to at least or about 18 inches. The outer diameter of the sidewalls can range between about at least 24 inches to at least 48 inches. The outer shape of the sidewalls may be symmetric or asymmetric. The two sidewalls of a spool may be both identical, mirror images of each other, or different. The spools may be suitable for stacking, which can facilitate efficient storage and transport of multiple devices together. The surface of the interior drum may be flat, or shaped. For example, the surface may have one or more grooves, indents, or the like. Optionally, these shapes may accommodate or the tubing when wound onto the spool and/or facilitate winding of the tubing onto the spool. For example, the surface of the interior drum adjacent to where tubing will be loaded or wound is matched to the shape of the tubing such that the tubing essentially fits into, or conforms with, the shape (such as a groove or indent) of the spool's interior drum. Illustrative examples are shown in FIG. 2.

The device may further comprise an aseptic or sterile liquid. The liquid can be any suitable liquid, for example the liquid may be a pharmaceutical or contain a pharmaceutical agent, a buffer, medium, nutrient, or the like. Additionally, the device may contain two or more liquids, either as a mixture or wherein each liquid is contained within a separate lumen in a multiple lumen tubing. Additionally or alternatively, the device may comprise at least one liquid in one lumen and at least one gas in a second lumen. At least one lumen may be open to the atmosphere, which would and allow for expansion of the liquid in the adjacent lumen during freezing.

Any of the above devices can also be used in a method of handling a sterile or aseptic liquid (e.g., a pharmaceutical, buffer, media, nutrient, or a combination thereof). Generally, the method comprises filling the coiled tubing with a sterile or aseptic liquid, sealing the ends of the coiled tubing, optionally storing and/or shipping the coiled tubing filled with liquid, and dispensing some or all of the liquid from the coiled tubing. In one embodiment, one or more ends of the tubing are sealed with a sterile connector. The tubing may be filled with the sterile or aseptic liquid through a sterile connector attached to one or both ends of the tubing.

The method may further comprise sterilizing the tubing either before and/or after filling the tubing with the liquid, although in general practice, the tubing would be at least sterilized before filing. Such sterilization may be achieved by steam, ethylene oxide, vaporized hydrogen peroxide, or radiation such as beta or gamma irradiation.

The method may further comprise recirculating the liquid within the tubing using a recirculating pump connected to the tubing. Recirculation may be useful where it is desirable to keep a product in suspension in the liquid (e.g., a vaccine or an antibody product), and/or mix one or more liquids in the tubing.

The method may further comprise monitoring the temperature, pH, pressure, gas content, or a combination thereof, of the liquid in the coiled tubing using one or more sensors connected to the tubing.

The method may further comprise maintaining, raising and/or lowering the temperature of the liquid in the tubing. For example, the liquid in the tubing may be subjected to heat, refrigeration or freezing temperatures.

The method may further comprise filtering the liquid simultaneously or sequentially with filling the tubing and/or with dispensing the liquid from the coiled tubing.

BRIEF DESCRIPTION OF THE DRAWINGS

The drawings are provided to illustrate one or more versions of the present invention and are not to be construed as limiting the scope of the claims.

FIG. 2A illustrates a grooved or indented surface of the interior drum. FIG. 2B illustrates a flat surface of the interior drum.

FIG. 3A shows a split ring configuration of one sidewall. The split ring can accommodate tubing ends, connectors, etc. FIG. 3B illustrates an optional concentric and radial alignment feature for attaching a sidewall to the interior drum of the spool. While shown with a split ring sidewall, the attachment features can be used with any form of sidewall. FIG. 3C illustrates the sidewall attached to the interior drum of the spool with the alignment feature shown in FIG. 3B.

FIG. 4A illustrates a sidewall having leg supports. Such legs can be spaced to facilitate use of forklift or pallet-jack to move the spools, with or without tubing. As shown in FIG. 4C, such legs can correspond to indents in a sidewall of a second spool to accommodate stacking of the spools as shown in FIG. 4D. Alternatively, a sidewall of a spool may comprise wheels or castors (see FIG. 4B). Additional spools may be stacked upon a spool having wheels or castors.

FIGS. 6A-6B illustrates possible tubing connections. A tubing end 10 may be attached to a connector 12. Optionally, the connector can be connected to a further element 14, which may be a pump, filter, air line, valve, sensor, or other element, or a combination thereof. This further element may be attached to a further connector 16. Connector 12 and/or 16 can be any suitable type of connector, including single use sterile connectors, multiple use sterile connectors, compression fittings, snap-fit connections, welded connections, and the like. FIG. 6B demonstrates one example of tubing end connections. The tubing 10 is connected to a pump (such as a disposable pump, or a reuseable pump) 14', which is driven by a motor 18, and connected to a sterile connector 16'.

DETAILED DESCRIPTION

Figure 1:
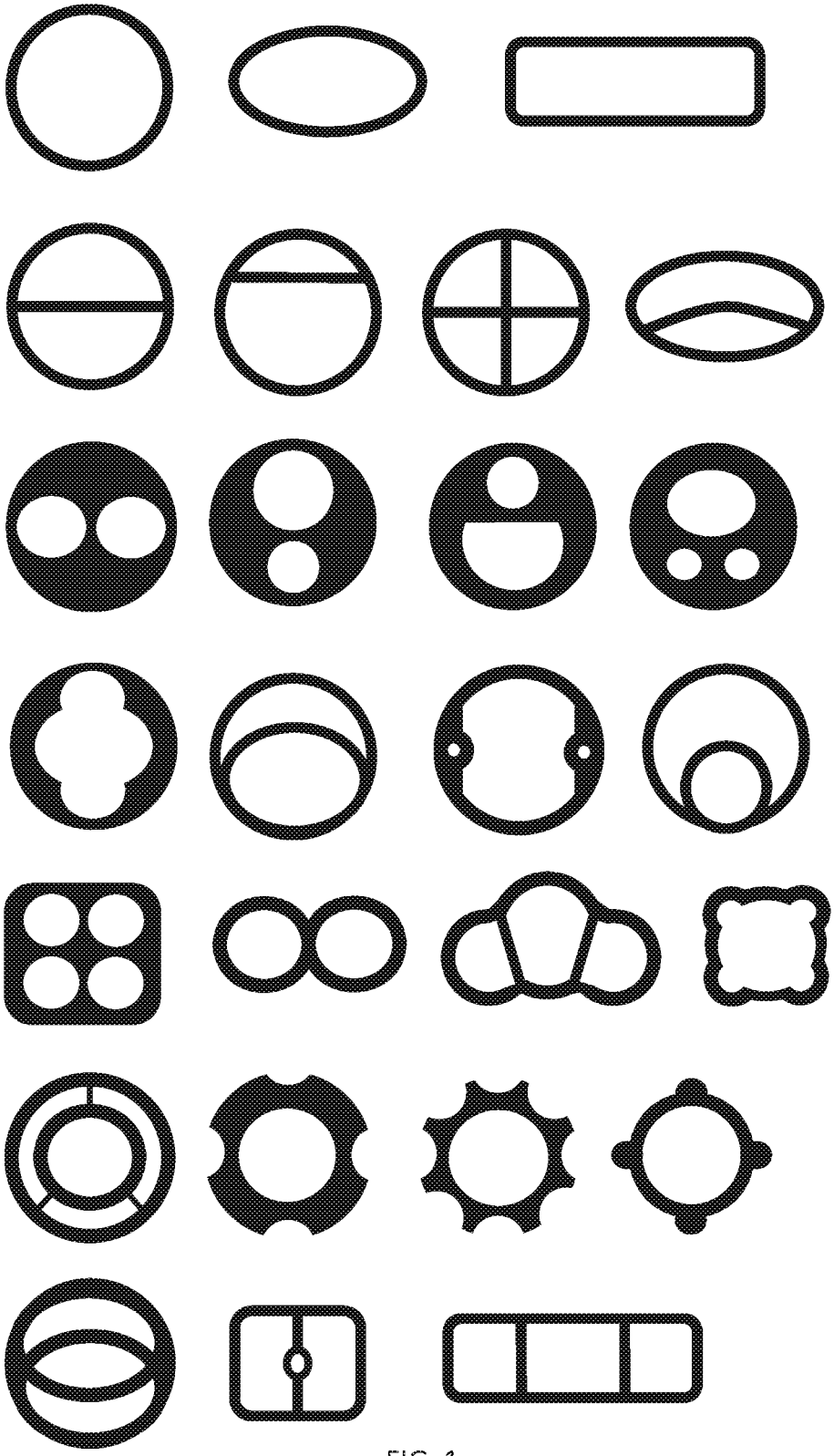
FIG. 1 illustrates a variety of cross-section profiles of tubing for both single lumen and multiple lumen tubing.

The devices described herein comprise a coiled tubing that facilitates the storage, handling and transport of bulk liquids. The tubing is preferably a continuous structure without seams or joints, although it is contemplated that two or more tubing structures may be joined together using a suitable connector. The tubing can be rigid, flexible, or a mixture thereof. As used herein, flexible has its ordinary meaning as being capable of flexing or bending without rupture or breakage under normal conditions and use. Rigid has its ordinary meaning of being resistant to substantial shape change under normal conditions and use. For example, one or both ends of the tubing may be flexible and the central coiled tubing may be rigid. Alternatively, the entire tubing can be flexible, or the entire tubing can be rigid. The tubing may have a smooth or ridged exterior surface.

The choice of tubing material may depend on the needs of the user. For example, the material may be gamma sterilization-stable, gas-impermeable, caustic-stable, pressure-resistant, pH-stable, impact-resistant, particle-free, low-extractable, low-leachable, temperature-stable, or a combination thereof. The tubing may comprise a single material, a composite material or blends, or layers of material, e.g., a laminate. Suitable materials include polymers, including thermoplastics. For example, polyethylene (PE), including low density or medium density polyethylene, linear low-density polyethylene (LLDPE), ultrahigh molecular weight polyethylene (UHMWPE), ethylene vinyl acetate (EVOH), polyethylene vinyl acetate ((P)EVA), ethylene vinyl acetate copolymers (EVA copolymers); polypropylene (PP); ethylene tetrafluoroethylene (ETFE); polyvinylidene fluoride (PVDF); fluoropolymer such as polytetrafluoroethylene (PTFE), Fluorinated ethylene propylene (FEP), perfluoroalkoxy alkane (PFA); silicone; rubber; and like materials. Typically, these tubing materials are medical grade and/or animal-free additive plastics. The tubing materials are generally sterilizable such as by steam, ethylene oxide, vaporized hydrogen peroxide, or radiation such as beta or gamma irradiation. Generally, the tubing is designed for single-use only and disposed of after use, although it is contemplated that the tubing can be reused after appropriate cleaning. In one aspect, the tubing is made from one layer of an extruded material or from multiple layers of co-extruded materials. Tubing can be commercially available tubing (e.g., from Saint-Gobain, Dow Corning, or AdvantaPure, etc.), or can be "custom formulated" to the user-defined application and shipping needs.

The size and diameter of the tubing will be determined according to volume capacity needs. For example, larger volumes will use longer lengths of tubing and/or larger diameter of the tubing lumen to be filled. As will be readily apparent, the exact lumen diameter and wall thickness can vary according to the total liquid volume to be filled in the tubing, the tubing material, and use of the tubing. Larger volumes will tend to use larger lumen diameter tubing and larger wall thickness. Increased wall thickness may also be appropriate under such circumstances as long term storage, long distance shipping, under circumstances of potential shock exposure, or in combination with a pressurized use such as for dispensing liquid under pressure. The wall thickness of the tubing can also be chosen according to desired properties of the tubing (e.g., tensile strength, temperature stable, gas-impermeable, etc.) and may vary according to the material used to make the tubing. In the case of a multiple lumen tubing, the wall thickness of the exterior may be the same or different from the wall thickness between lumens. For illustrative purposes, the diameter of one or more lumens in the tubing can range between at least or about 0.125 inches to at least or about 1 inch. The wall thickness of the tubing may range from about 0.010 inches to about 0.25 inches. Furthermore, the wall thickness may be varied to facilitate winding the tubing onto a spool. For example, tubing can be made by extrusion with an offset mandrel such that one wall side has a thicker wall thickness (e.g., 0.1 inches) and the opposite wall thickness is thinner (e.g., 0.02 inches). As the tubing is extruded, it will naturally extrude in a coiled shape. Such tubing manufacturing is not limited to extrusion methods, but can also be achieved by injection molding, for example. In practice, the lumen diameter and tubing wall thickness will be dependent on the properties of the tubing material, as will be appreciated by those of skill in the art.

While not intended to be limiting, examples of tubing cross-section profiles with a single or multiple lumens are illustrated in FIG. 1. Multiple lumens can be used to store, handle and/or transport multiple liquids. Additionally or alternatively, one or more lumens in a multiple lumen tubing can be unfilled with liquid (e.g., filled with air or another gas), which can allow for expansion of liquid in another lumen under freezing conditions. Such use of a multiple lumen tubing avoids potential rupture of the tubing due to liquid expansion upon freezing.

Either or both ends of the tubing may further comprise one or more attachments. Such attachments include, for example, adapter, sterile connector, valve, sensor, recirculating pump, filter, or a combination thereof. Such attachments can permit the aseptic filling and/or dispensing of the liquid, monitor the liquid in the tubing (e.g., temperature, pH, gas content, flow rate etc.), recirculate the liquid in the tubing to keep any solids in suspension (e.g., this can be particularly suitable for vaccines that contain some solid or particulate materials), and/or filtering the liquid during filling and/or dispensing of the liquid from the tubing. For sterile or aseptic applications, sterile connectors may be used to connect these attachments to the tubing. For non-sterile applications, quick connect fittings would be suitable. Additionally, one or both ends of the tubing may be heat sealed.

Since large volumes of liquid are contemplated to be stored and handled in the tubing described herein, it is advantageous to store the tubing coiled on a spool. A spool can help facilitate the handling, storage and shipment of large amounts of coiled tubing filed with liquid. In general, the spool comprises an interior drum and at least two sidewalls. The spool can be made of any suitable material so long as it is capable of being loaded with the coiled tubing. For example, the spool can comprise plastic, metal, alloys, glass, wood, foam, composite materials, or combinations thereof. The outer sidewalls of the spool and the interior drum can each comprise the same or different materials.

In general, the spool dimensions can be standardized according to the size and quantity of tubing to be coiled onto the spool. It is preferable to have a diameter of the interior drum that minimizes or avoids kinking or collapse of the tubing once coiled onto the spool. For example, the diameter of the interior drum can range between at least or about 3 inches to at least or about 18 inches. The diameter of the sidewalls can range between at least or about 36 inches to at least or about 48 inches.

Figure 2A:
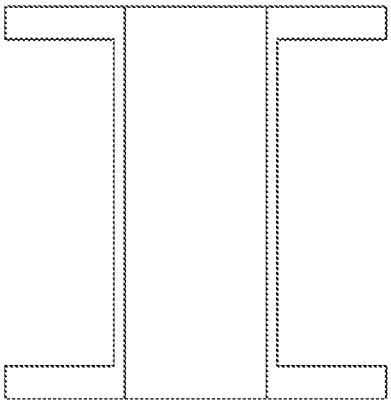
FIGS. 2A-2B illustrate examples of the surface of the interior drum of a spool.
Figure 2B:
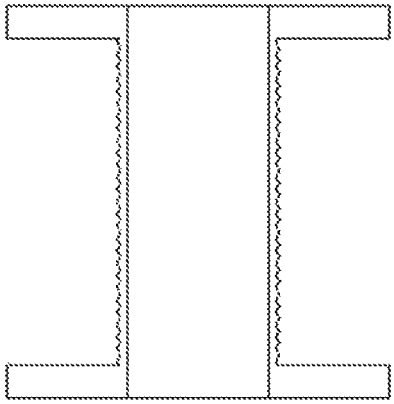

The shape of the outer sidewalls of the spool can be any variety of shapes, including for example, symmetrical, asymmetrical, circular, square, rectangular, hexagonal, and the like. The shape of the outer sidewalls can vary according to whether the spool is stored and/or handled with the coiled tubing loaded horizontally or vertically. Examples of possible configurations are shown in the figures for illustrative purposes. The surface of the interior drum may be flat, or shaped, or a combination thereof. For example, the surface may have one or more grooves, indents, or the like. The grooves or indents may extend across the entire surface of the interior drum (such as shown in FIG. 2B), or the surface of the interior drum may only partially have grooves or indents. For example, a groove or indent may be located at the surface of the interior drum that is adjacent one or both sidewalls and the remaining surface of the interior drum is flat. Alternatively, the surface of the interior drum that is adjacent one or both sidewalls is flat and the remaining surface of the interior drum is grooved or indented. Optionally, these shapes may accommodate or the tubing when wound onto the spool and/or facilitate winding of the tubing onto the spool, avoid kinking of the tubing, etc. In a particular example, the surface of the interior drum adjacent to where tubing will be loaded or wound is matched to the shape of the tubing such that the tubing essentially fits into, or conforms with, the shape (such as a groove or indent) of the spool's interior drum.

Figure 3A:
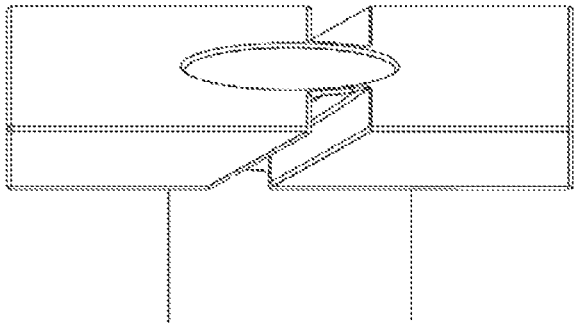
FIGS. 3A-3C show a split ring spool sidewall, as well as an alignment feature for attaching or mating a sidewall to the interior drum of a spool.
Figure 3B:
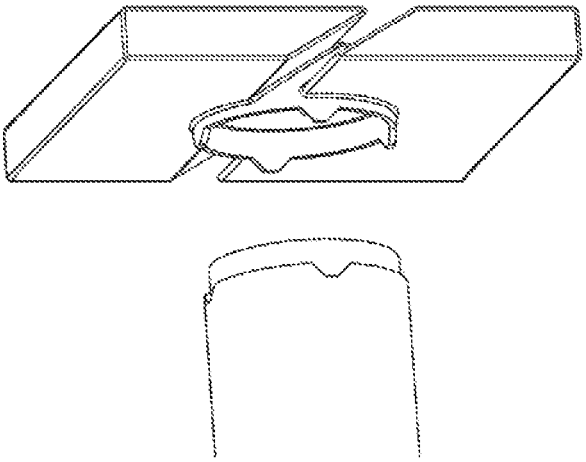
Figure 3C:
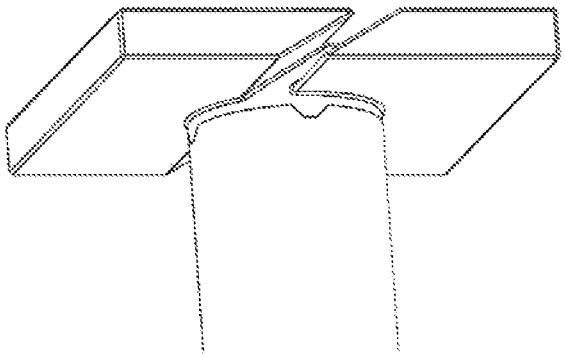
Figure 4A:
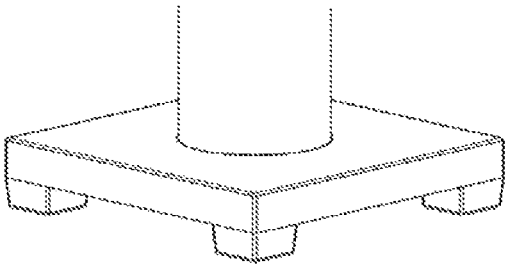
FIGS. 4A-4D illustrate examples of a sidewall configuration.
Figure 4B:
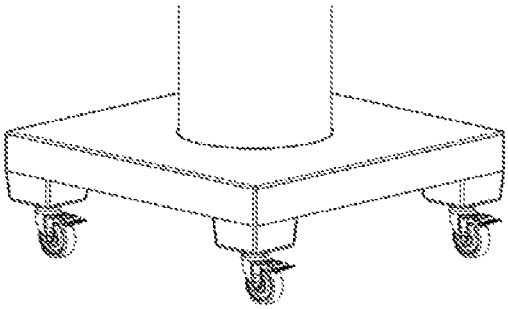
Figure 4C:
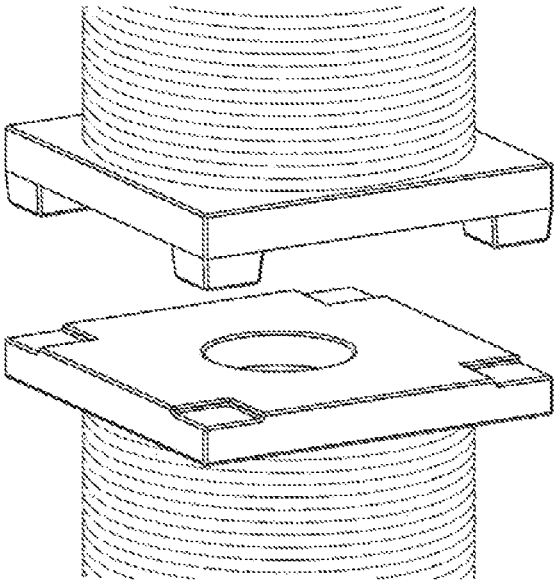
Figure 4D:
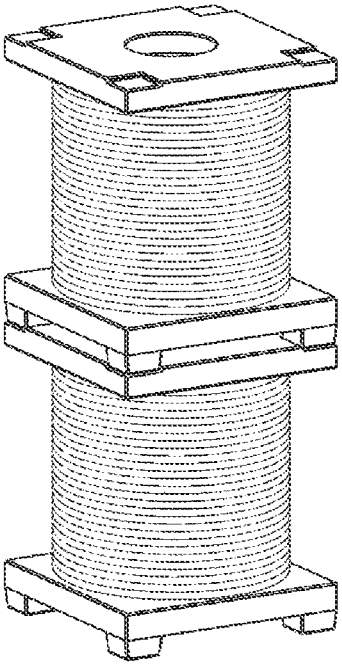
Figure 5A:
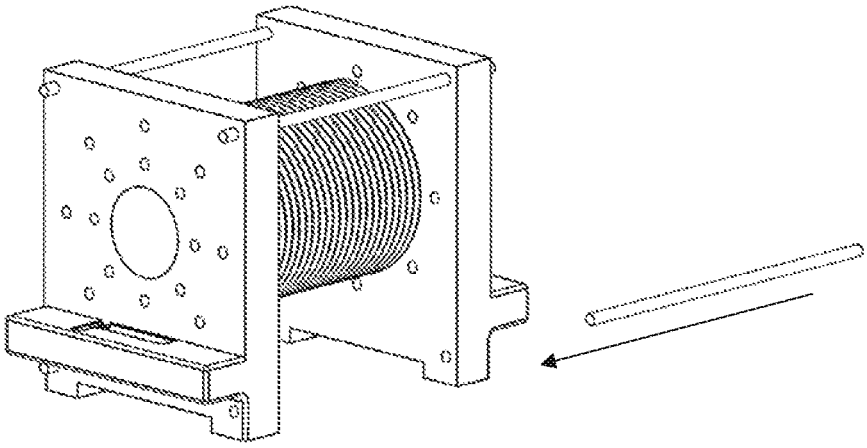
FIGS. 5A-5B illustrate sidewalls comprising flanges and optional spool supports. Such flanges on the sidewalls are suitable for facilitating use of machinery, such as a forklift, to move the spools with or without tubing. Additionally, a spool may further comprise supports, such as rods (see FIG. 5A). The supports may be removable. These supports may be useful where additional stability is desired. The supports are compatible with stacking multiple spools (see FIG. 5B).
Figure 5B:
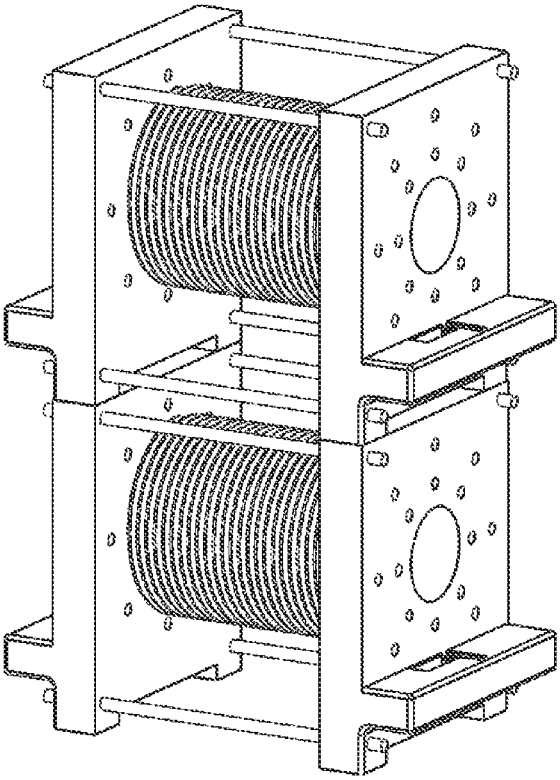
Figure 6A:
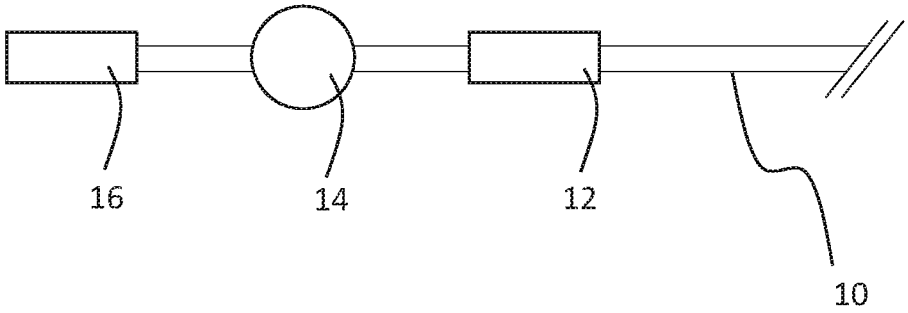
Figure 6B:
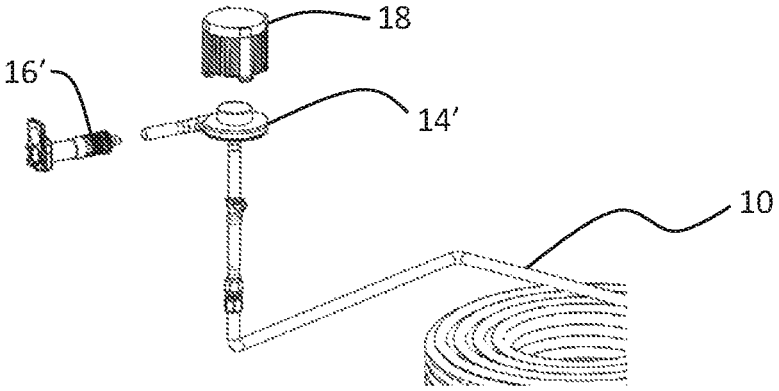
Figure 7A:
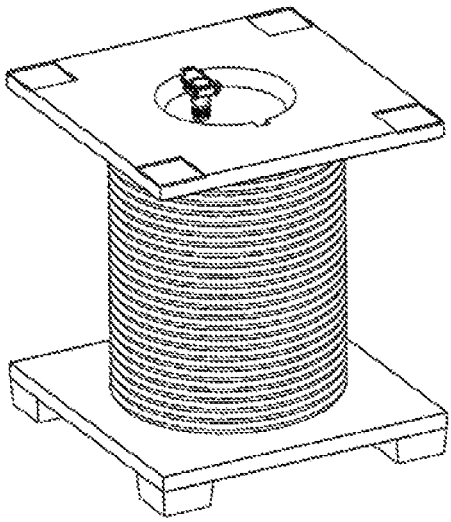
FIGS. 7A-7D illustrate examples of connector locations on a spool. One or more connectors can be located through the center of the spool (FIGS. 7A and 7C). One or more connectors may be located on an edge or side of a sidewall (FIG. 7B). One or more connectors can be located at one or more corners of a sidewall (FIG. 7D). The connectors may be nested in the sidewall or separate from the sidewall.
Figure 7B:
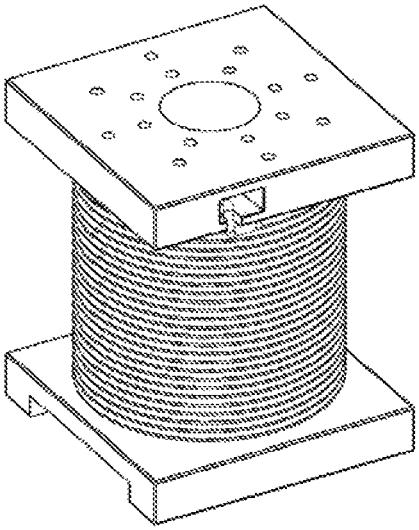
Figure 7C:
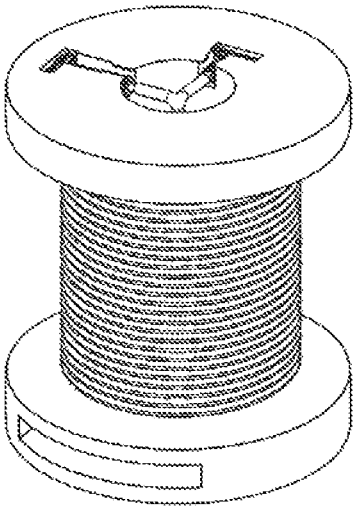
Figure 7D:
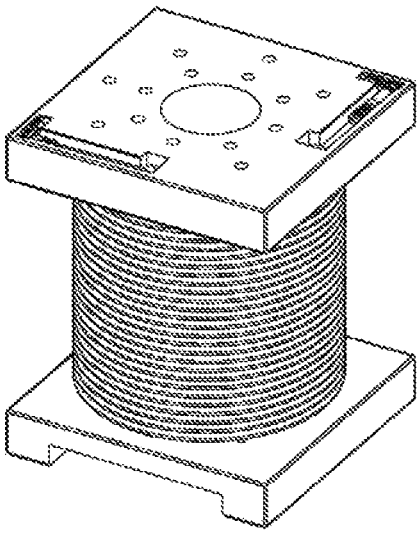

It is also contemplated that the spool can be assembled from, and/or disassembled into, at least two or more parts (e.g., FIG. 3). For example, each sidewall and the interior drum can be separate pieces. Alternatively, each sidewall may also comprise a portion of the interior drum such that assembly of both sidewalls forms a complete interior drum. Each part of the spool can feature a click-lock mechanism, threaded assembly, bolts, clamps, or use a tie rod or rods that extend through the drum and can be secured at each end with a nut, or other suitable mating mechanism. The unassembled or disassembled spool can be stored and shipped in less space than an assembled spool.

The spool may additionally comprise other features. For example, the spool may further comprise legs, a stand, stabilizers, counterweights, crank handles, clamps, clips, notches, grooves, and/or carrying handles. Such features can facilitate the use of the spool and coiled tubing. For example, legs, stand, stabilizers and/or counterweights can assist in positioning of the spool. The clamps, clips or notches can be used for attaching the tubing to the spool. The crank handles can assist with winding and unwinding the tubing on the spool. Grooves can be used to guide the tubing during winding onto the spool. Additionally or alternatively, the spool may comprise a cover that at least partially or completely surrounds the spool and coiled tubing. This cover may further protect the coiled tubing (e.g., from impact), maintain an enclosed space for the coiled tubing (e.g., to control temperature, keep the tubing clean from dirt, dust, block light), etc. Furthermore, the spool may further comprise a sensor (e.g., to detect temperature, pressure, impact, moisture, radiation, and the like).

The coiled tubing and/or the spool may further comprise a tracking device. Such devices include wireless devices like radio-frequency identification (RFID) with read or read/write capabilities. Such devices can record the date, time, location, user identification, serial number and other such information as may be useful to track during, for example, manufacture, transport, filling, storing, dispensing and disposal, etc.

In general, the tubing is attached at one end to the spool and wound onto the spool until the desired amount of tubing is loaded onto the spool. Connectors can be attached to either or both ends of the tubing by any suitable means, e.g., compression fitting, quick connectors, snap fit connectors, push connect fittings, welding, adhesion bonding, etc.

The devices described herein can be used in methods of handling a sterile or aseptic liquid. In general, the method comprises filling a coiled tubing as described above with a sterile or aseptic liquid. Optionally, more than one lumen in a multiple lumen coiled tubing can be filled with a liquid. Typically, the coiled tubing has a size and length sufficient to contain a liquid volume of at least or about 10 liters to at least or about 1000 liters. The ends of the coiled tubing are sealed, for example either or both ends of the tubing can be sealed with one or more sterile connectors, or one or more ends can be heat sealed, or a combination thereof where one end has a sterile connector and the other end is heat sealed. The liquid is now ready to be stored and/or shipped before dispensing from the coiled tubing.

As described above, the tubing may further comprise a recirculation pump, filter, sensor, valve, connector for, or a connection to, a pressurized (preferably sterile) air source, or a combination thereof. The method may further comprise recirculating the liquid in the tubing; and/or monitoring one or more conditions such as temperature, pH, pressure, gas content, or a combination thereof; and/or filtering the liquid.

Additionally, the method may further comprise raising, maintaining and/or lowering the temperature of one or more liquids in the tubing. For example, with a multi-lumen tubing, one or more lumens may be filled with a cold or frozen gas or liquid to maintain or lower the temperature. Similarly, one or more lumens may be filled with a warm or hot liquid or gas to maintain or raise the temperature. Such heated or cooled liquids or gases may be recirculated to maintain a constant temperature of the liquid in the tubing.

The devices and methods described herein overcome and number of the disadvantages of the current devices and methods. These devices permit the handling, storage and shipping of large quantities of liquids without the same risk of leaks and contamination that are possible with large bags due to wrinkling and presence of seams. Furthermore, the tubing is readily integrity tested, unlike large volume bags and other containers. Additionally, the tubing can be adapted to any liquid volume and avoids unnecessary or undesirable air space kept with the liquid. For example, a rigid container will necessarily contain air in any volume not filled with liquid, leading to possible foaming and the associated problems such as protein denaturation in the liquid being handled, stored and/or shipped. This problem is avoided with the use of the coiled tubing as described herein since the tubing can be sealed to exclude any air pockets.

While this invention has been particularly shown and described with reference to example embodiments thereof, it will be understood by those skilled in the art that various changes in form and details may be made therein without departing from the scope of the invention encompassed by the appended claims. It should also be appreciated that the various technical features of the described devices may be combined in various ways to produce alternative and additional embodiments.

The teachings of all patents, published patent applications, and references cited herein are incorporated by reference in their entirety.

What is claimed is:

1. A method of handling a sterile or aseptic liquid comprising:

a) filling a coiled tubing with a sterile or aseptic liquid, wherein the coiled tubing has a size and length sufficient to contain a liquid volume of at least 10 liters to at least 1000 liters;

b) sealing the ends of the coiled tubing;

c) storing and/or shipping the coiled tubing filled with liquid; and d) dispensing some or all of the liquid from the coiled tubing, further comprising filtering the liquid simultaneously or sequentially with dispensing the liquid from the coiled tubing.

2. The method of claim 1 further comprising a spool for supporting the coiled tubing.

3. The method of claim 1, wherein the tubing comprises a gamma sterilization-stable, thermoplastic material and is gas-impermeable, caustic-stable, pressure-resistant, pH-stable, impact-resistant, particle-free, low-extractable, low-leachable, temperature-stable, or a combination thereof.

4. The method of claim 1, wherein the tubing comprises multiple lumens and one or more lumens is filled with a liquid.

5. The method of claim 1, wherein the tubing comprises at least one sterile connector at one end of the tubing or comprises a sterile connector at each end of the tubing.

6. The method of claim 1 further comprising recirculating the liquid within the tubing using a recirculating pump connected to the tubing.

7. The method of claim 1 further comprising dispensing the liquid from the coiled tubing by gravity flow, pumping, or introducing pressurized air.

8. The method of claim 1 further comprising monitoring the temperature, pH, pressure, gas content, flow rate, or a combination thereof, of the liquid in the coiled tubing using one or more sensors connected to the tubing.

9. The method of claim 1, wherein the tubing is composed of a single material or a composite of materials.

10. The method of claim 1, wherein the liquid comprises a pharmaceutical, buffer, media, nutrient, or a combination thereof.

11. The method of claim 1 further comprising raising, maintaining and/or lowering the temperature of one or more liquids in the tubing.

* * * * *